US005170601A

United States Patent [19]

Geisen et al.

[11] Patent Number: 5,170,601

[45] Date of Patent: Dec. 15, 1992

[54] THIN SLAB OF PLASTIC MATERIAL ADAPTED TO COVER THE TERRACES OF BUILDINGS

[75] Inventors: Pierre Geisen, Strasbourg; Bernard Ducret, Schwindratzheim, both of France

[73] Assignee: Soprema, S.A., Strasbourg, France

[21] Appl. No.: 651,724

[22] Filed: Feb. 7, 1991

[30] Foreign Application Priority Data

Feb. 9, 1990 [FR] France ..... 90 01712

[51] Int. Cl.[5] ..... E04F 15/02

[52] U.S. Cl. ..... 52/177; 52/392

[58] Field of Search ..... 404/35, 41, 45; 52/126.6, 389-392, 589-595, 177

[56] References Cited

U.S. PATENT DOCUMENTS

| | | | |
|---|---|---|---|
| 519,873 | 5/1894 | Pope | 404/41 |
| 1,741,745 | 12/1929 | Thompson | 404/45 |
| 2,680,698 | 6/1954 | Schnee | 404/35 |
| 4,745,715 | 5/1988 | Hardwicke et al. | 52/126.6 |
| 4,749,302 | 6/1988 | DeClute | 404/37 |
| 4,825,603 | 5/1989 | Hardwicke et al. | 52/126.6 |

FOREIGN PATENT DOCUMENTS

| | | | |
|---|---|---|---|
| 0328639 | 8/1989 | European Pat. Off. . | |
| 2302299 | 5/1974 | Fed. Rep. of Germany . | |
| 2109533 | 5/1972 | France . | |
| 812671 | 4/1959 | United Kingdom | 52/594 |

*Primary Examiner*—James L. Ridgill, Jr.
*Attorney, Agent, or Firm*—Young & Thompson

[57] ABSTRACT

The present invention relates to a thin slab of plastic material adapted to cover the terraces of buildings.

Thin slab of plastic material adapted to cover the terraces of buildings, particularly for use in covering arrangements of the type of thin slabs on blocks, characterized in that it has, on the one hand, on its undersurface, a partitioned structure constituted by recesses or depressions (1) and partitions (5), on the other hand, a border (2) at its periphery, and, finally, on its upper surface, a flange (6) defining a space (7) adapted to receive a surface coating, as well as, on its lateral surfaces, means (3, 10) permitting assembly with adjacent thin slabs.

4 Claims, 3 Drawing Sheets

THIN SLAB OF PLASTIC MATERIAL ADAPTED TO COVER THE TERRACES OF BUILDINGS

The present invention relates to the field of buildings and has for its object thin slabs of plastic material adapted in particular to be positioned on blocks so as to cover, for example, the terraces of buildings, particularly those which are accessible to the public.

The terraces of buildings are now covered, at present, by concrete slabs resting on blocks arranged as a large slab which is preferably provided with a water-tight covering. These concrete slabs, which have a thickness of 4 to 5 cm, have however the drawback of being difficult to transport because of their weight, particularly when they are used on penthouse terraces of high buildings.

They also have the drawback of being difficult to cut to size, requiring frequent changing of the molds used for this purpose, and the corresponding drawback of being relatively fragile.

The present invention has for its object to overcome these various drawbacks of concrete slabs by providing thin slabs of plastic material which have both the advantage of light weight and ease of installation, while enabling numerous variations of design.

The present invention thus has for its object a thin slab of plastic material which is essentially characterized in that it has, on its undersurface, a partitioned structure, at the periphery of its surface a flange delimiting a space adapted to receive a surface covering, and on its lateral surfaces means permitting its assembly with adjacent thin slabs.

These thin slabs may be used particularly with support blocks, so as to constitute covering arrangements of the type of thin slabs on blocks. Such devices permit in particular on the one hand to provide flat surfaces avoiding declivities and compensating irregularities of the substrate to be covered, and, on the other hand, easy discharge of rain water. The blocks used are preferably blocks of adjustable height, such as described in French patent No. 2 603 639 and in the application for French certificate of addition No. 2 638 477. According to the shape of the thin slabs, each block will support partially a variable number of thin slabs, these latter being adapted moreover to rest on said blocks and be secured by means of clips.

The thin slab according to the invention can be provided in any suitable hard plastic material, however it is preferably made of polypropylene or polyvinylchloride, and can be obtained by injection molding.

The partitioned structure of its undersurface can have various geometric forms and is comprised by recesses or depressions and partitions, extending either all the way across the underside of the thin slab, or only in localities or along predetermined directions.

Thus, the thin slab according to the invention can comprise an undersurface having overall a regular partitioned structure of recessed configuration, said recesses having preferably an octagonal shape. This structure gives to the thin slab very great rigidity, uniformly distributed, for a limited volume of constituent material.

Nevertheless, according to an embodiment of the thin slab according to the invention, the undersurface may be constituted by partitions in the form of ribs or stiffening walls, extending along predetermined bearing axes and each connecting at least two bearing points of the thin slab on the support blocks, between themselves.

The thin slab thus has, for a minimum volume of material, maximum rigidity and load bearing capacity.

The upper surface of the thin slab according to the invention can be finished in the factory or at the job site by a surface coating adapted to fill the space defined by the upper flange of each thin slab, this coating can be anti-skid and have also aesthetic qualities and sound-deadening qualities.

The thin slab according to the invention finally has on its lateral surfaces means permitting its assembly with adjacent thin slabs, so as to overcome its light weight by enabling it to resist wind forces and to prevent its theft when integrated into a large size assembly. These means can have various forms, being adapted to comprise a keying or clipping or mortise and tenon system.

To this end, a thin slab can have on its four lateral surfaces tenons of a certain length while the adjacent thin slabs can have on their four lateral surfaces mortises adapted to coact with said tenons, or even to have on two lateral facing surfaces a tenon and on the two other lateral surfaces a mortise.

The present invention will be better understood from a reading of the description which follows, of two of its embodiments shown in the accompanying drawings, it being of course understood that this description is non-limiting as to the invention.

The thin slab according to the invention has preferably the shape of a regular polygon such as for example a square of 40 to 50 cm, while the flange of its upper surface has preferably a width of about 4 to 5 mm and a height of about 0.5 to 1 cm, this height being a function of the nature of the surface covering.

Figure 1:
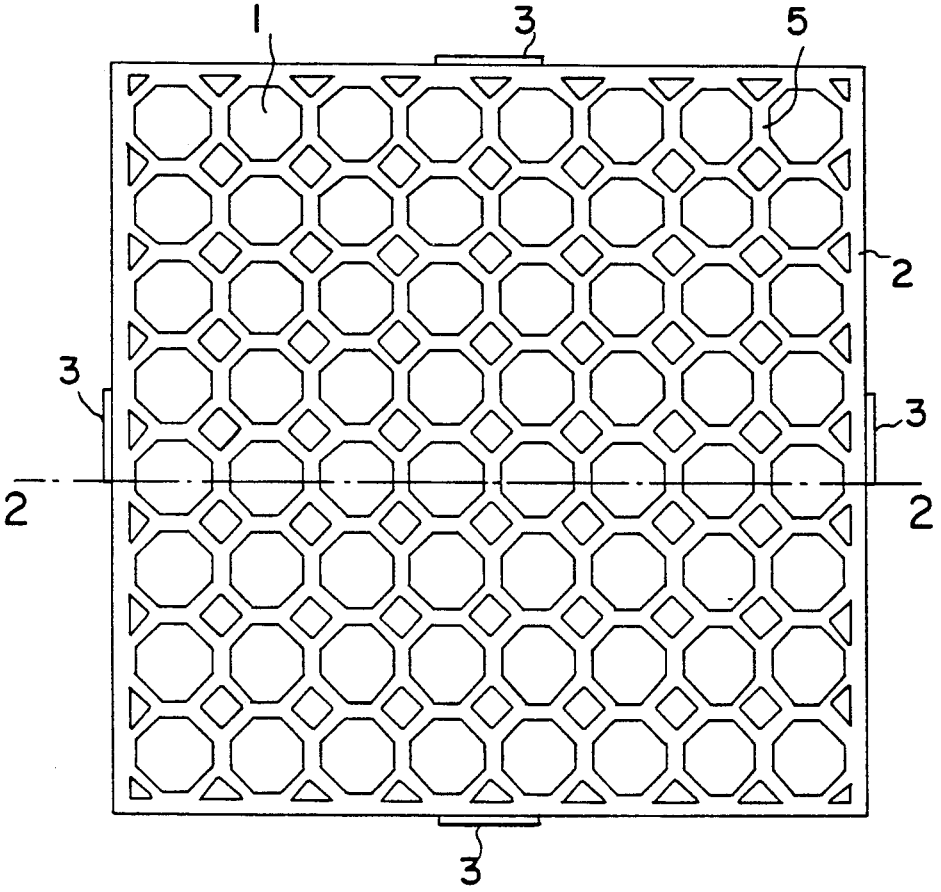
FIG. 1 shows a plan view of the undersurface of a thin slab according to the invention.

Referring first to FIG. 1, it will be seen that the thin slab according to the invention is a thin square slab, having on its undersurface recesses 1, octagonal in this case, regularly arranged, defined by partitions 5, a border 2 being provided at the periphery of the thin slab, in the form of lateral boundary walls. Because of its uniformly recessed structure, the thin slab thus constructed can be cut off in any manner without its rigidity being lessened or its structure weakened.

On each of its lateral surfaces, and approximately at their midpoint, is located a tenon 3 of a length of about 5 cm, adapted to coact with slides provided at the same places on the adjacent thin slabs.

Figure 2:
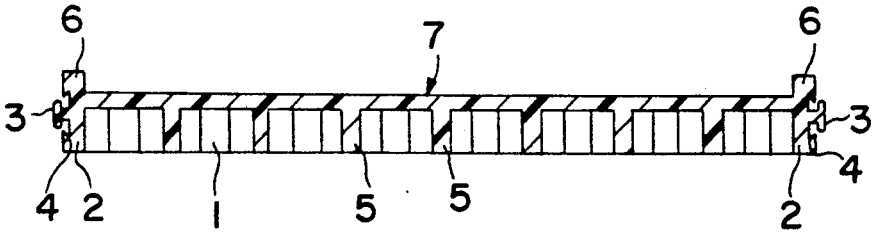
FIG. 2 shows a cross-sectional view of the same thin slab on line 2—2 of FIG. 1.

Referring to FIG. 2, it will be seen that the tenons 3 are disposed in grooves 4 provided on the lateral surfaces of the thin slab, whose recesses 1 are defined by partitions 5. On its upper surface, the thin slab has a flange 6 defining a space 7 adapted to receive the surfacing material. This latter preferably consists of a rubber agglomerate which can absorb sound waves as well as impacts, and has good characteristics of cohesion and is long lasting, while having anti-skid properties and being of low cost.

Figure 3:
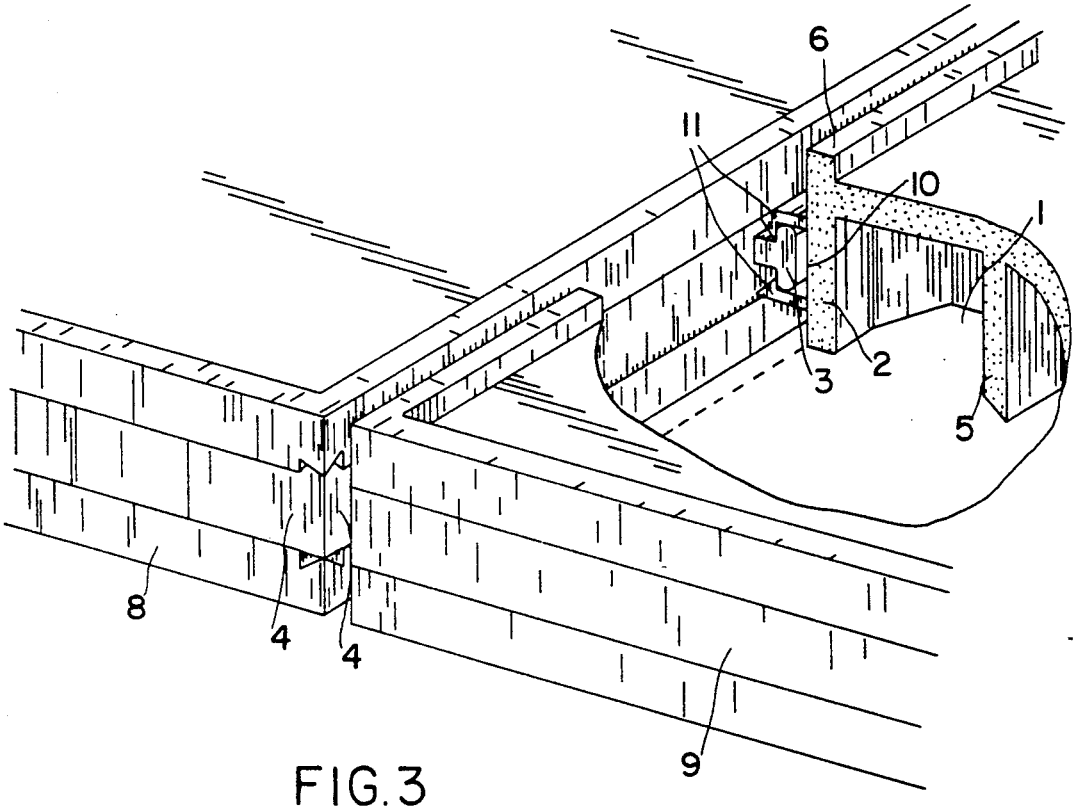
FIG. 3 shows a perspective view, partially broken away, of the lateral surfaces of two adjacent thin slabs assembled by a system of clips.

Referring to FIG. 3, there will be seen in this figure two adjacent thin slabs 8 and 9 of which one, the thin slab 8, comprises a male securement element while the other, the thin slab 9, comprises a female securement element. This thin slab has on two of its facing surfaces a groove 4 from which projects a tenon 3 and on its two other lateral surfaces a protuberant slideway 10, whose ends 11 comprise a re-entrant element bisected at its external surface, so as to permit the insertion of the tenon 3 of the adjacent thin slab. There will also be seen in this figure a recess 1 of the thin slab 9 defined by a partition 5 and the flange 2 of the thin slab, prolonged at its upper portion by the flange 6.

Figure 4:
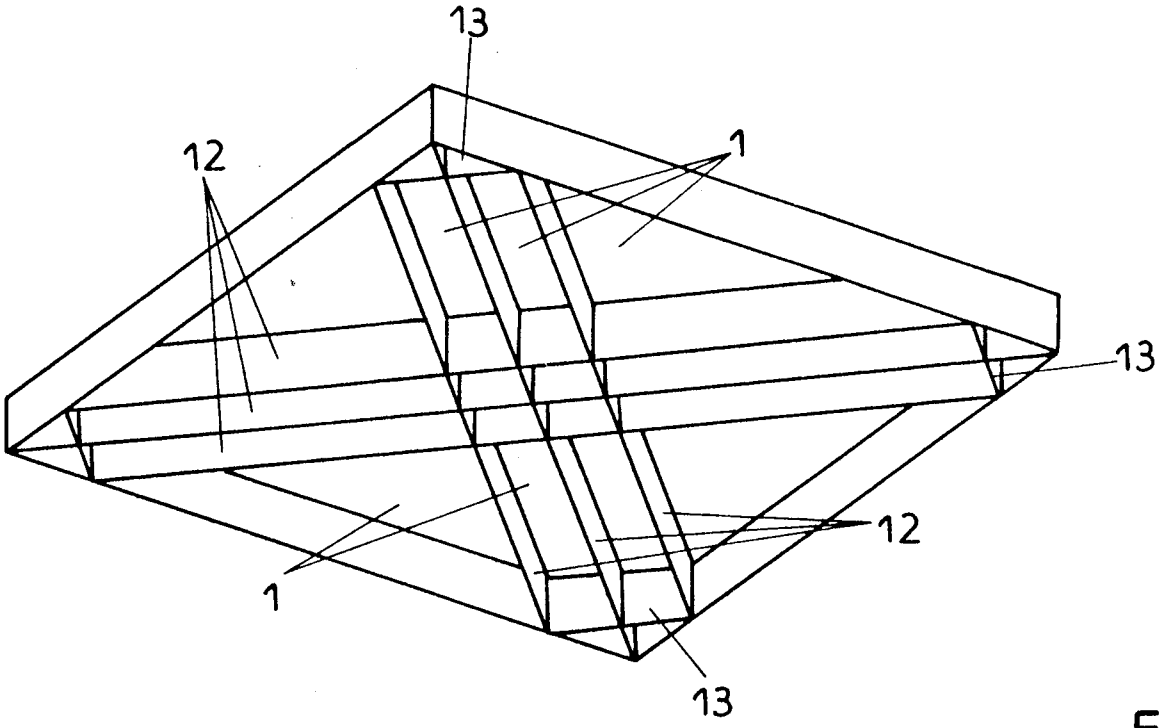
FIG. 4 shows a schematic perspective view of a modified embodiment of thin slab according to the invention.

Referring finally to FIG. 4, showing schematically a modified embodiment of the thin slab according to the invention, there will be seen in this figure a thin slab of square shape whose undersurface is constituted by depressions 1 delimited by ribs or stiffening walls 12 extending on diagonals and crossing each other, between the corners of the thin slab, which constitute bearing points for this latter on the support blocks. So as to increase the rigidity of this thin slab, said stiffening ribs 12 can also be interconnected adjacent the bearing points of the thin slab, by transverse ribs 13.

Thanks to the invention, it is accordingly possible to provide thin slabs of plastic material, of any shape, adapted particularly to coact with support blocks. These thin slabs have maximum rigidity and load bearing capability, because of the specific partitioned structure of their undersurface, reducing also the quantity of material necessary for their production. Moreover, the thin slabs according to the invention permit the construction of any surface covering whatever, which can have properties adapted to the requirements of the user and the environment as well as aesthetic characteristics of color, design and structure.

Of course, the invention is not limited to the embodiment described and shown in the accompanying drawings. Modifications remain possible, particularly as to the construction of the various elements or by substitution of technical equivalents, without thereby departing from the scope of protection of the invention.

We claim:

1. A slab adapted to cover terraces of building, comprising a thin flat slab of molded hard plastic having on its underside a partitioned structure constituted by recesses spaced apart by partitions, a border at its periphery, on its upper surface an upstanding peripheral flange extending about the entire periphery of the slab and defining a single space adapted to receive a surface covering, said slab having on its side edges interlocking means for interlocking assembly with adjacent thin slabs by relative movement of said slabs in a direction parallel to said edges.

2. Slab according to claim 1, wherein said hard plastic is polypropylene or polyvinylchloride.

3. Slab according to claim 1, which has on at least two of said side edges a groove from which projects a tenon of a length substantially less than the length of said side edge.

4. Slab according to claim 3, having on at least two of said side edges at about their middle a protruding slideway whose ends comprise a re-entrant element bisected at its external surface so as to permit the insertion of the tenon of an adjacent slab.

* * * * *